US009816348B2

(12) United States Patent
Asthana et al.

(10) Patent No.: US 9,816,348 B2
(45) Date of Patent: Nov. 14, 2017

(54) DOWNHOLE FLOW CONTROL ASSEMBLIES AND METHODS OF USE

(71) Applicant: Halliburton Energy Services, Inc., Houston, TX (US)

(72) Inventors: Pranay Asthana, Spring, TX (US); Winfred Cajiles, Spring, TX (US); Jeremy Ramirez, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 23 days.

(21) Appl. No.: 14/900,301

(22) PCT Filed: Mar. 24, 2015

(86) PCT No.: PCT/US2015/022281
§ 371 (c)(1),
(2) Date: Dec. 21, 2015

(87) PCT Pub. No.: WO2016/153491
PCT Pub. Date: Sep. 29, 2016

(65) Prior Publication Data

US 2017/0089170 A1 Mar. 30, 2017

(51) Int. Cl.
*E21B 34/06* (2006.01)
*E21B 34/14* (2006.01)
(Continued)

(52) U.S. Cl.
CPC ..... *E21B 34/06* (2013.01); *E21B 34/14* (2013.01); *E21B 43/12* (2013.01); *E21B 2034/002* (2013.01); *E21B 2034/007* (2013.01)

(58) Field of Classification Search
CPC ..... E21B 34/14; E21B 34/06; E21B 2034/007
See application file for complete search history.

(56) References Cited

U.S. PATENT DOCUMENTS 5,957,208 A 9/1999 Schnatzmeyer
5,979,558 A 11/1999 Bouldin et al.
(Continued)

FOREIGN PATENT DOCUMENTS

AU 767839 B2 11/2003
EP 2526324 A1 11/2012
(Continued)

OTHER PUBLICATIONS

International Search Report and Written Opinion for PCT/US2015/022273 dated Dec. 2, 2015.
(Continued)

*Primary Examiner* — David Andrews
*Assistant Examiner* — Kristyn Hall
(74) *Attorney, Agent, or Firm* — McDermott Will & Emery LLP

(57) ABSTRACT

A flow control assembly includes a cylindrical body defining an interior and one or more openings through a wall of the body, and a composite choke assembly positioned within the body. The composite choke assembly includes an inner sleeve made of a first material and defining choke orifices that coincide with the openings, and an outer sleeve sized to receive the inner sleeve within the outer sleeve and being made of a second material that is more ductile than the first material. The outer sleeve defines sleeve orifices alignable with the choke orifices to facilitate fluid communication through the composite choke assembly. A flow control device is movably disposed within the body between a fully open position, where the choke orifices and the sleeve orifices are exposed, and a fully closed position, where the choke orifices and the sleeve orifices are occluded by the flow control device.

20 Claims, 10 Drawing Sheets

(51) Int. Cl.
*E21B 43/12* (2006.01)
*E21B 34/00* (2006.01)

(56) References Cited

U.S. PATENT DOCUMENTS

| | | | |
|---|---|---|---|
| 6,082,458 | A | 7/2000 | Schnatzmeyer |
| 6,715,558 | B2 | 4/2004 | Williamson |
| 6,722,439 | B2 | 4/2004 | Garay et al. |
| 7,377,327 | B2 | 5/2008 | Jackson |
| 2003/0132001 | A1 | 7/2003 | Wilson et al. |
| 2004/0041120 | A1 | 3/2004 | Haughom et al. |
| 2004/0112608 | A1 | 6/2004 | Jackson |
| 2011/0139453 | A1 | 6/2011 | Schultz et al. |
| 2014/0174746 | A1 | 6/2014 | George et al. |
| 2014/0224504 | A1 | 8/2014 | McGeoch et al. |
| 2014/0251627 | A1 | 9/2014 | Holderman et al. |

FOREIGN PATENT DOCUMENTS

| | | | | |
|---|---|---|---|---|
| EP | 2607616 | A1 * | 6/2013 | ..... E21B 34/14 |
| WO | 2011085286 | A2 | 7/2011 | |
| WO | 2011088548 | A1 | 7/2011 | |

OTHER PUBLICATIONS

International Search Report and Written Opinion for PCT/US2015/022281 dated Dec. 9, 2015.

* cited by examiner

DOWNHOLE FLOW CONTROL ASSEMBLIES AND METHODS OF USE

BACKGROUND

Flow control devices, such as sliding or rotating sleeve assemblies and downhole valves, are often used in a production tubing string of a downhole completion to selectively regulate flow of fluids into and out of the production tubing string. A device called a "choke" is also often incorporated into the flow control device to throttle (i.e., "choke") the fluid flow, and thereby provide adjustable flow metering and pressure control between the well annulus and the production tubing at the maximum possible flowing differential pressure. Flowing differential pressure is defined as the pressure difference between immediately inside and immediately outside of the choke.

Chokes are also designed to facilitate a long service life against erosion due to solid laden produced fluids. Due to the extremely high flow velocities seen through a downhole choke during operation, the standardized industry materials of choice for chokes include carbides, such as tungsten carbide, or equivalent hard ceramics or ceramic alloys that mitigate erosion. Although adequate for erosion resistance, such materials are brittle and prone cracking or shattering due to elevated vibrations and high flowing differential pressures often experienced during injection operations.

Typical chokes used in conjunction with downhole flow control devices have a cylindrical geometry designed to fit within the confines of the generally round flow control devices. Cylindrical chokes typically have symmetrical flow performance due to equal and opposite spaced orifices that operate to cancel the energy of the flow streams coming in or going out of the choke. The oppositely spaced orifices in the cylindrical chokes also mitigate erosion in the interior of the flow control device caused by impinging jets, vortices, and turbulent flow, and thereby generally act as a shield.

While the aforementioned features are admirable, cylindrical chokes inherently suffer from circumferential stresses (also called hoop stresses) generated in the cross-section of the choke. Such circumferential stresses are due to the differential pressure of fluid acting from the inner radial fiber to the outer radial fiber, and thereby risking fracture of the erosion-resistant material at peak stress. Accordingly, one the limiting factor for cylindrical choke performance is the maximum allowable hoop stress by nature of the cylindrical geometry, which in turn is dictated by the pressure drop or flowing differential achieved before the maximum stress is reached. Another limitation of cylindrical chokes is that they have pre-defined flow characteristics by way of the in-built orifice design, which are often not replaceable externally without disassembly of the flow control device.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
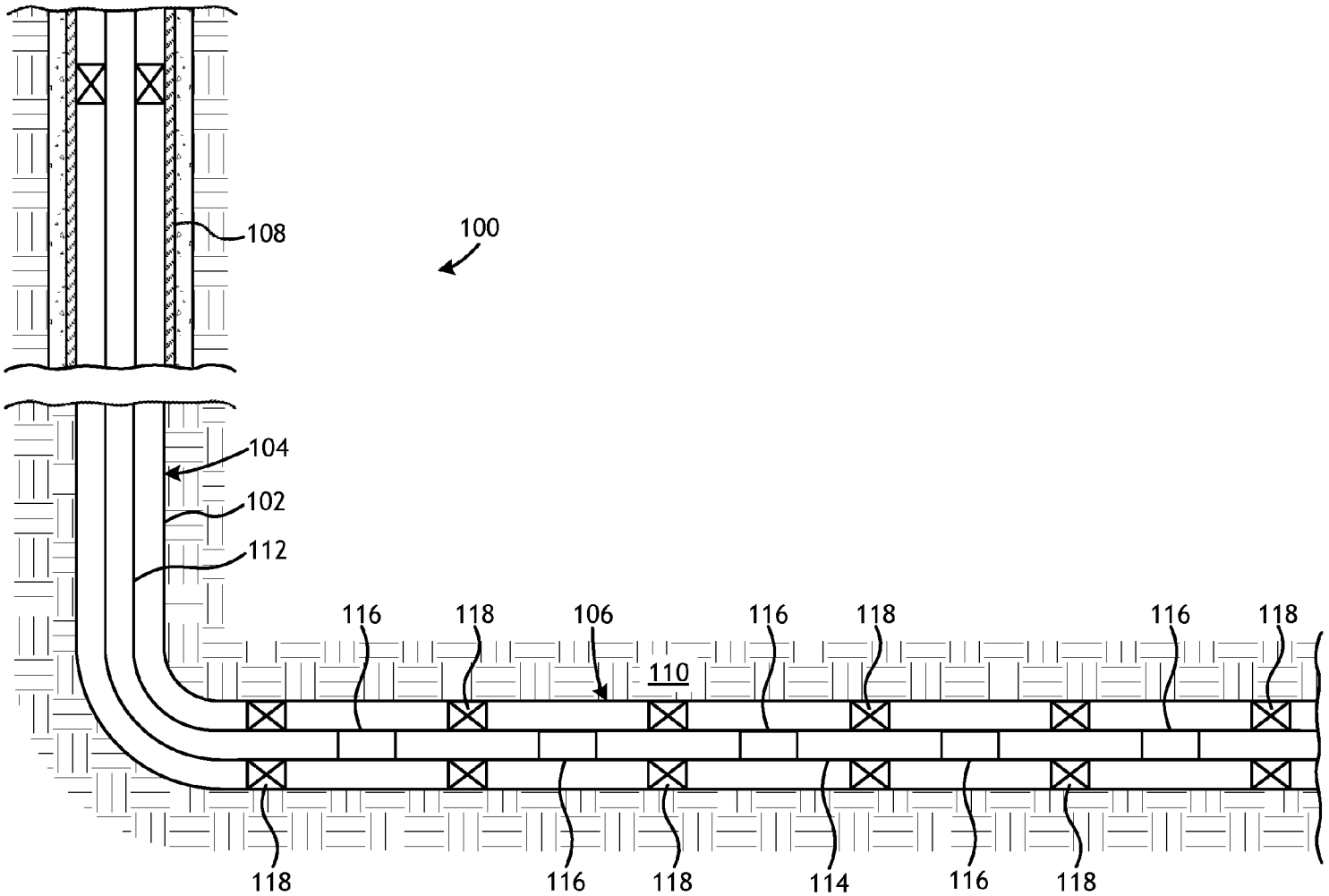
FIG. 1 is a schematic diagram of a well system that may employ the principles of the present disclosure.

The present invention relates generally to systems utilized to control fluid flow in a subterranean well and, more particularly, to flow control devices that provide choking assemblies that selectively regulate fluid flow into or out of a tubing string disposed within a well.

Embodiments disclosed herein provide a flow control assembly that can be used in production or injection operations. The flow control assembly may include a cylindrical body that defines an interior and one or more openings provided through a wall of the body. An inner sleeve may be positioned within the interior of the body and define one or more recessed pockets on an outer radial surface of the inner sleeve. The one or more recessed pockets may coincide with the one or more openings, and one or more sleeve orifices may be defined in the inner sleeve at each recessed pocket. A cartridge choke assembly may be received within each opening and may be operatively coupled to the inner sleeve at a corresponding one of the one or more recessed pockets. The cartridge choke assembly may include a choking module that defines one or more choke orifices that are alignable with the one or more sleeve orifices to facilitate fluid communication through the cartridge choke assembly. A flow control device may be movably disposed within the body between a fully open position, where the one or more sleeve orifices are exposed and fluid flow into or out of the body via the cartridge choke assembly is facilitated, and a fully closed position, where the one or more sleeve orifices are occluded by the flow control device and fluid flow into or out of the body via the cartridge choke assembly is thereby prevented.

The embodiments described herein also provide an alternative flow control assembly that may be used in production or injection operations. This alternative flow control assembly may also include a cylindrical body that defines an interior and one or more openings provided through a wall of the body. A composite choke assembly may be positioned within the body and include an inner sleeve made of a first material and defining one or more choke orifices that coincide with the one or more openings. An outer sleeve may be sized to receive the inner sleeve within the outer sleeve and may be made of a second material that is more ductile than the first material. The outer sleeve may define one or more sleeve orifices alignable with the one or more choke orifices to facilitate fluid communication through the composite choke assembly. A flow control device may be movably disposed within the body between a fully open position, where the one or more choke orifices and the one or more sleeve orifices are exposed and fluid flow into or out of the body via the composite choke assembly is facilitated, and a fully closed position, where the one or more choke orifices and the one or more sleeve orifices are occluded by the flow control device and fluid flow into or out of the body via the composite choke assembly is thereby prevented.

Referring to FIG. 1, illustrated is a well system 100 that may employ the principles of the present disclosure, according to one or more embodiments. As depicted, the well system 100 includes a wellbore 102 that extends through various earth strata and has a substantially vertical section 104 that extends to a substantially horizontal section 106. The upper portion of the vertical section 104 may have a casing string 108 cemented therein, and the horizontal section 106 may extend through a hydrocarbon bearing subterranean formation 110. In at least one embodiment, the horizontal section 106 may be arranged within or otherwise extend through an open hole section of the wellbore 102. In other embodiments, however, the horizontal section 106 may be cased.

A tubing string 112 may be positioned within the wellbore 102 and extend from the surface (not shown). At its lower end, the tubing string 112 may be coupled to and otherwise form part of a downhole completion 114 arranged within the horizontal section 106. The downhole completion 114 serves to divide the completion interval into various intervals adjacent the formation 110. In production operations, the tubing string 112 provides a conduit for fluids extracted from the formation 110 to travel to the surface and, therefore, may be characterized as production tubing. In injection operations, however, the tubing string 112 provides a conduit for fluids to be injected into the formation and, therefore may be alternatively characterized as an injection tubing.

As depicted, the downhole completion 114 may include a plurality of flow control assemblies 116 axially offset from each other along portions of the downhole completion 114. In some embodiments, each flow control assembly 116 may be positioned between a pair of packers 118 that provides a fluid seal between the downhole completion 114 and the wellbore 102, thereby defining corresponding intervals along the length of the downhole completion 114. As described in greater detail below, each flow control assembly 116 may be configured to selectively regulate fluid flow into and/or out of the tubing string 112, depending on whether a production or an injection operation is being undertaken.

It should be noted that even though FIG. 1 depicts the flow control assemblies 116 as being arranged in an open hole portion of the wellbore 102, embodiments are contemplated herein where one or more of the flow control assemblies 116 is arranged within cased portions of the wellbore 102. Also, even though FIG. 1 depicts a single flow control assembly 116 arranged in each interval, it will be appreciated by those skilled in the art that any number of flow control assemblies 116 may be deployed within a particular interval without departing from the scope of the disclosure. In addition, even though FIG. 1 depicts multiple intervals separated by the packers 118, it will be understood by those skilled in the art that the completion interval may include any number of intervals with a corresponding number of packers 118 arranged therein. In other embodiments, the packers 118 may be entirely omitted from the completion interval, without departing from the scope of the disclosure.

While FIG. 1 depicts the flow control assemblies 116 as being arranged in the horizontal section 106 of the wellbore 102, those skilled in the art will readily recognize that the flow control assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
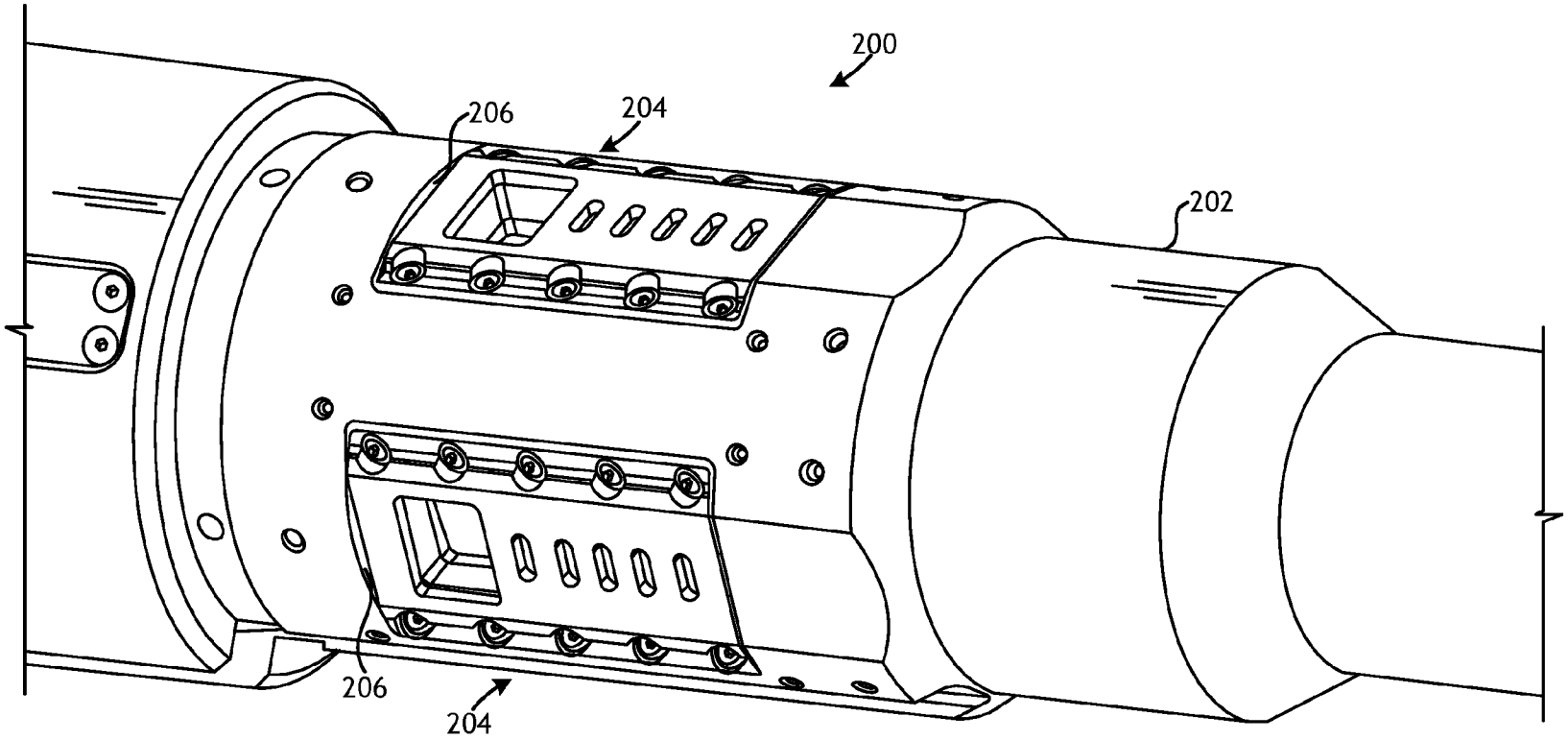
FIG. 2 is an isometric view of an exemplary flow control assembly.

Referring now to FIG. 2, with continued reference to FIG. 1, illustrated is an isometric view of an exemplary flow control assembly 200, according to one or more embodiments. The flow control assembly 200 (hereafter "the assembly 200") may be the same as or similar to any of the flow control assemblies 116 of FIG. 1. Accordingly, the assembly 200 may interpose upper and lower portions or lengths of the tubing string 112 (FIG. 1) in the downhole completion 114 (FIG. 1) and may otherwise be used in both production and injection operations.

As illustrated, the assembly 200 may include an elongate cylindrical body 202 and one or more cartridge choke assemblies 204 (two shown). The body 202 may define and otherwise provide one or more openings 206, where each opening 206 is configured to receive a corresponding one of the cartridge choke assemblies 204. Accordingly, the number of openings 206 in the body 202 corresponds to the number of cartridge choke assemblies 204 employed in the assembly 200. In some embodiments, two cartridge choke assemblies 204 may be employed in the assembly 200 and may be positioned 180° offset from each other about the circumference of the body 202. In other embodiments, however, such as in the illustrated embodiment, four cartridge choke assemblies 204 (two hidden) may be employed in the assembly 200 and positioned 90° offset from each other about the circumference of the body 202. In yet other embodiments, more than four cartridge choke assemblies 204 may be employed in the assembly 200, such as five or more. In even further embodiments, three cartridge choke assemblies 204 may be employed in the assembly 200 and angularly offset from each other by 120° about the circumference of the body 202.

Figure 3A:
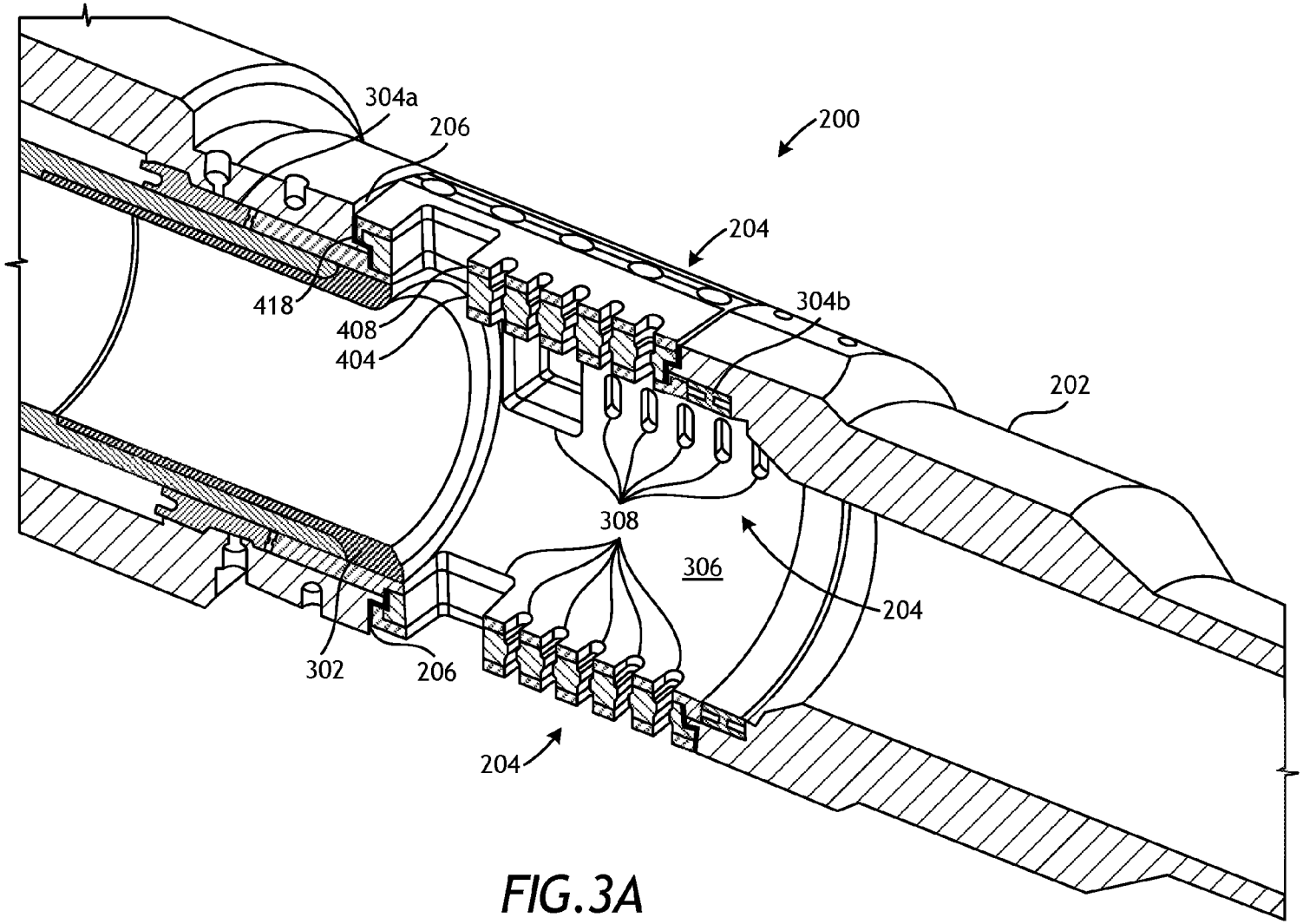
FIGS. 3A and 3B depict isometric, cross-sectional side views of the flow control assembly of FIG. 2.
Figure 3B:
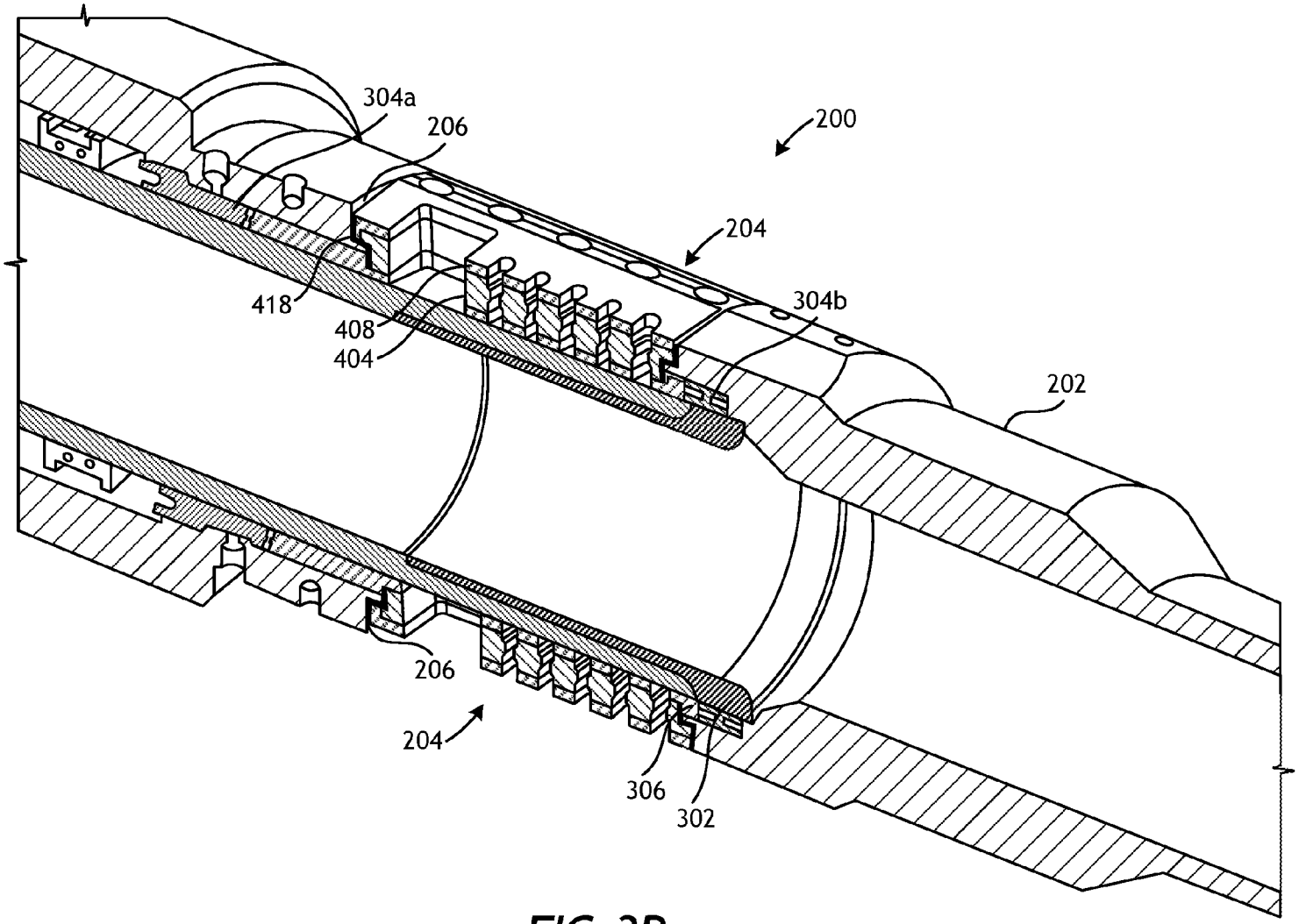

FIGS. 3A and 3B each depict an isometric, cross-sectional side view of the assembly 200, where FIG. 3A depicts the assembly 200 in a fully open position, and FIG. 3B depicts the assembly 200 in a fully closed position. In the illustrated embodiment, four cartridge choke assemblies 204 are employed in the assembly 200 and positioned within corresponding openings 206 defined in the body 202. The assembly 200 may include a flow control device 302 movably disposed within the body 202. The flow control device 302 may be any type of flow regulating device known to those of skill in the art. In the illustrated embodiment, the flow control device 302 is depicted as a sliding sleeve that is axially movable within the body 202 between a first position (i.e., the fully open position), as shown in FIG. 3A, and a second position (i.e., the fully closed position), as shown in FIG. 3B. In other embodiments, however, the flow control device 302 may comprise a rotating sleeve, a sliding plug, a rotating ball, an oscillating vane, an opening pocket, an opening window, or a valve capable of actuating the assembly 200 between the fully open and fully closed positions, without departing from the scope of the disclosure.

The flow control device 302 may be selectively actuated between the fully open and closed positions, and any position therebetween, using any suitable actuation device. In some embodiments, for instance, the flow control device 302 may be axially moved within the body 202 using a hydraulic actuation device. In other embodiments, however, the flow control device 302 may be actuated with a mechanical, electromechanical, or pneumatic actuation device, without departing from the scope of the disclosure. The flow control device 302 may further be selectively actuated from a remote location, such as a surface location. In such embodiments, the actuation device that moves the flow control device 302 may be communicably coupled to the surface location, and an operator may be able to send command signals to the actuation device to selectively move the flow control device 302 between the fully open and closed positions, and any position therebetween, as desired. In other embodiments, however, the flow control device 302 may be partially or fully automated. In such embodiments, for instance, control of the flow control device 302 may be dependent on a measured pressure drop across the cartridge choke assemblies 204.

The assembly 200 may further include an upper seal 304*a* and a lower seal 304*b* axially positioned within the body 202 on either axial end of the cartridge choke assemblies 204. The upper seal 304*a* may interpose the body 202 and the flow control device 302 when the assembly 200 is in the fully open and fully closed positions. The lower seal 304*b*, however, may interpose the body 202 and the flow control device 302 when the assembly 200 is in the fully closed position. When in radial contact with the flow control device 302, fluid migration past the upper and lower seals 304*a,b* in either direction may be substantially prevented. Accordingly, when the flow control device 302 is in the fully closed position, as shown in FIG. 3B, fluid migration into or out of the assembly 200 via the cartridge choke assemblies 204 may be substantially prevented.

In some embodiments, one or both of the upper and lower seals 304*a,b* may be characterized as a dynamic seal. The term "dynamic seal," as used herein, refers to a seal that provides pressure and/or fluid isolation between members that have relative displacement therebetween, for example, a seal that seals against a displacing surface, or a seal carried on one member and sealing against the other member. The upper and lower seals 304*a,b* may be made of a variety of materials including, but not limited to, an elastomer, a metal, a composite, a rubber, a ceramic, a thermoplastic, any derivative thereof, and any combination thereof. In at least one embodiment, one or both of the upper and lower seals 304*a,b* may form a metal-to-metal seal against the flow control device 302.

The assembly 200 may also include an inner sleeve 306 positioned within the body 202 and generally extending between the upper and lower seals 304*a,b* such that the inner sleeve 306 interposes the upper and lower seals 304*a,b*. In some embodiments, the inner sleeve 306 may be made of an erosion-resistant material such as, but not limited to, a carbide grade (e.g., tungsten, titanium, tantalum, vanadium, etc.), a carbide embedded in a matrix of cobalt or nickel by sintering, a ceramic, a surface hardened metal (e.g., nitrided metals, heat-treated metals, carburized metals, etc.), a surface coated metal, a cermet-based material, a metal matrix composite, a nanocrystalline metallic alloy, an amorphous alloy, a hard metallic alloy, diamond, or any combination thereof.

As shown in FIG. 3A, the inner sleeve 306 may define and otherwise provide one or more sleeve orifices 308 that extend through the wall of the inner sleeve 306. As described in more detail below, the sleeve orifices 308 may be configured to align with corresponding orifices (not labeled) defined in each cartridge choke assembly 204, and thereby enabling fluid flow through the cartridge choke assemblies 204 either into or out of the assembly 200. The flow control device 302 may be movable to throttle or "choke" the fluid flow through the cartridge choke assemblies 204, and thereby intelligently regulate the flow rate into or out of the assembly 200. Moving the flow control device 302 toward the fully open position (FIG. 3A), for instance, may result in increased fluid flow into or out of the assembly 200 as additional orifices 308 progressively become exposed. In contrast, moving the flow control device 302 toward the fully closed position (FIG. 3B) may result in decreased fluid flow into or out of the assembly 200 as the orifices 308 progressively become occluded by the flow control device 302.

Figure 4A:
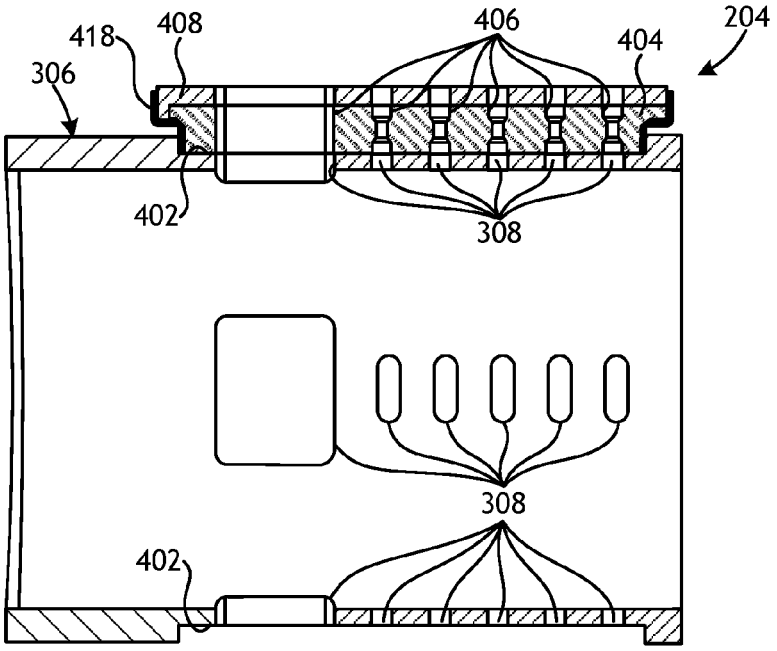
FIGS. 4A and 4B depict cross-sectional side and exploded isometric views, respectively, of a given cartridge choke assembly.
Figure 4B:
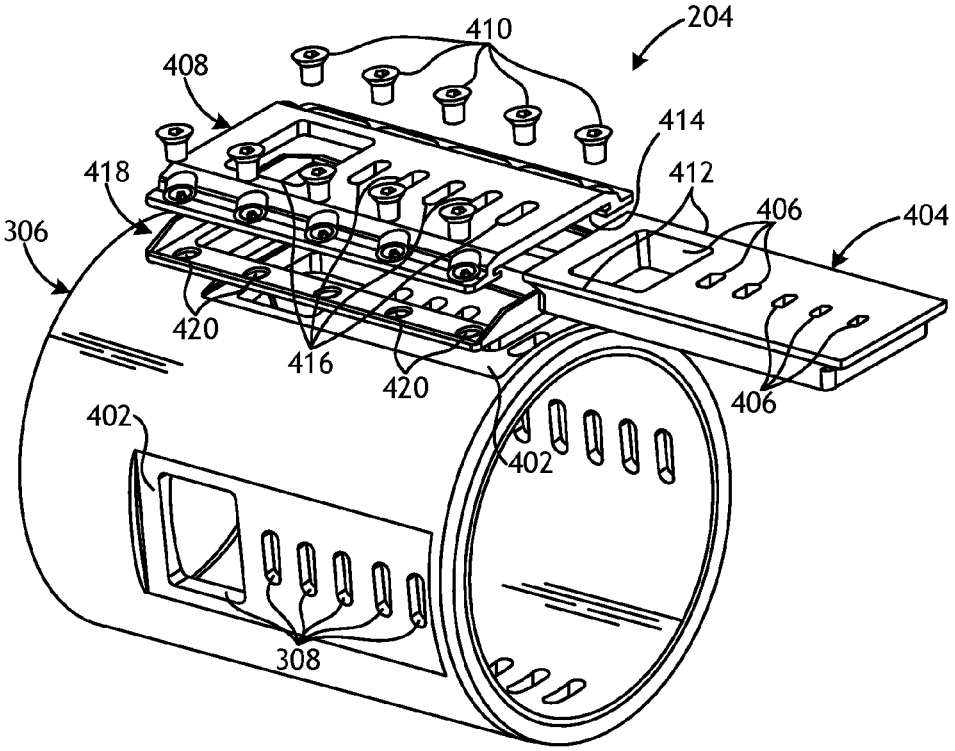

Referring now to FIGS. 4A and 4B, with continued reference to FIGS. 3A and 3B, illustrated are cross-sectional side and exploded isometric views, respectively, of a given cartridge choke assembly 204 and the inner sleeve 306, according to one or more embodiments. For simplicity, only one cartridge choke assembly 204 is depicted in FIGS. 4A and 4B, but the following description of the cartridge choke assembly 204 may be applicable to all other cartridge choke assemblies 204 used in the assembly 200 (FIGS. 2 and 3A-3B). As illustrated, the inner sleeve 306 may define one or more recessed pockets 402 on its outer radial surface. Each recessed pocket 402 may be configured to coincide and otherwise align with a corresponding one of the openings 206 defined in the body 202. Moreover, each recessed pocket 402 may be configured to receive and seat a corresponding cartridge choke assembly 204. As a result, the number of openings 206, recessed pockets 402, and cartridge choke assemblies 204 may be equal. As depicted, the sleeve orifices 308 of the inner sleeve 306 may be defined so as to coincide with the recessed pockets 402.

The cartridge choke assembly 204 may include a choking module 404 that defines and otherwise provides one or more choke orifices 406 that extend through the body of the choking module 404. The choke orifices 406 may be configured to generally align with the sleeve orifices 308 to facilitate fluid communication through the cartridge choke assembly 204. The choking module 404 may be made of a hard or erosion-resistant material, such as any of the erosion-resistant materials listed herein for the inner sleeve 306. In some embodiments, however, only a portion of the choking module 404 may be made of the erosion-resistant material, as will be discussed in greater detail below.

The choking module 404 may be seated within the recessed pocket 402 and operatively coupled to the inner sleeve 306. As used herein, the term "operatively coupled" refers to a direct or indirect coupling between two structural elements. Accordingly, in at least one embodiment, the choking module 404 may be operatively coupled to the inner sleeve 306 by being coupled directly thereto using, for example, one or more mechanical fasteners or the like.

In other embodiments, however, the cartridge choke assembly 204 may further include a choke clamp 408 that may be used to operatively couple and otherwise secure the choking module 404 to the inner sleeve 306. As best seen in FIG. 4B, the choke clamp 408 may include a plurality of mechanical torque fasteners 410 extendable through axially aligned holes provided in both the choke clamp 408 and the inner sleeve 306. The mechanical torque fasteners 410 may be tightened to place a compressive load on the choking module 404, which may help mitigate the potential for cracking or failure of the choking module 404 when assuming mechanical stresses during operation. As will be appreciated, however, the mechanical torque fasteners 410 may be replaced with any type of mechanical locking system capable of placing a pre-compression load on the choking module 404.

To be able to place a pre-compression load on the choking module 404, the choke clamp 408 may be contoured and otherwise designed to receive the choking module 404. As best seen in FIG. 4B, the choking module 404 may provide flanged sides 412 that extend from the body of the choking module 404, and the choke clamp 408 may provide and otherwise define a profile 414 configured to receive the flanged sides 412. In at least one embodiment, the flanged sides 412 may slide into the profile 414 laterally to be received by the choke clamp 408. As will be appreciated, such a sliding configuration may prove advantageous since during the useful life of the cartridge choke assembly 204, several different types or configurations of the choking module 404 may be used, and the interaction between the flanged sides 412 and the profile 414 may simplify the process of assembly and disassembly of the choking module 404.

As labeled in FIG. 4B, the choke clamp 408 may further define and otherwise provide one or more clamp orifices 416. When the choke clamp 408 is used, the clamp orifices 416 may be configured to generally align with the choke orifices 406 and the sleeve orifices 308 to facilitate fluid communication through the cartridge choke assembly 204. Accordingly, the number of sleeve orifices 308, choke orifices 406, and clamp orifices 416 may be equal. In some embodiments, the sleeve orifices 308 and the clamp orifices 416 may exhibit a larger diameter and may otherwise be wider than the choke orifices 406.

In some embodiments, the cartridge choke assembly 204 may further include a gasket 418 that interposes the choke clamp 408 and the inner sleeve 306. The gasket 418 may be contoured and otherwise shaped to be seated within the recessed pocket 402 and receive the choking module 404 and the choke clamp 408. In some embodiments, the gasket 418 may be configured to provide an interference fit with one or both of the choking module 404 and the choke clamp 408. As illustrated, the gasket 418 may further include a plurality of holes 420 (FIG. 4B) that are axially alignable with the holes defined in the choke clamp 408 and the inner sleeve 306 to receive the mechanical torque fasteners 410. As a result, the mechanical torque fasteners 410 may also extend through the holes 420 in securing the choke clamp 408 to the inner sleeve 306 and otherwise placing a compressive load on the choking module 404.

The gasket 418 may be made of a variety of materials suitable for downhole use. Example materials for the gasket 418 include, but are not limited to, an elastomer, a rubber, a plastic, a metal, a highly viscous chemical compound, and any combination thereof. Depending on the material selected, the gasket 418 may prove useful in mitigating vibration effects in the cartridge choke assembly 204, and thereby providing a cushion against vibration that may be induced due to fluid flow and other operational factors. Moreover, depending on the material selected, the gasket 418 may also be useful swabbing off fluid trying to intersperse or circulate in the interface between the choking module 404 and the inner sleeve 306. Accordingly, in at least one embodiment, the gasket 418 may operate as a seal between the inner sleeve 306 and the cartridge choke assembly 204.

Referring again to FIGS. 3A and 3B, and especially FIG. 3A, the inner sleeve 306 may operate to provide erosion protection to the inner surfaces of the body 202 and other features of the assembly 200 (e.g., the lower seal 304*b*) that may lie in the vicinity of impinging fluid flow streams passing through the cartridge choke assemblies 204. More particularly, sand particles and other debris entrained in fluid flow streams traversing the cartridge choke assemblies 204 may impact the inner wall of the body 202 and result in erosion or abrasion. Since it is made of an erosion-resistant material, however, the inner sleeve 306 may mitigate or prevent erosion to the body 202 that might otherwise ensue due to impinging jets, vortices, and turbulent flow through the cartridge choke assemblies 204.

Moreover, the symmetrical arrangement of the cartridge choke assemblies 204 about the circumference of the body 202 may enable cancellation of at least a portion of the energy of fluid flow streams entering or exiting the assembly 200 via the cartridge choke assemblies 204. In the illustrated embodiment, the sleeve orifices 308, the choke orifices 406 (FIG. 4A), and the clamp orifices 416 (FIG. 4B) may be aligned and arranged such that the fluid flow streams entering the assembly 200 via the symmetrically arranged cartridge choke assemblies 204 may enter at an angle substantially orthogonal to the longitudinal axis of the assembly 200. As a result, the incoming fluid flow streams may impact each other within the body 202 and substantially dissipate the energy prior to impinging upon the inner sleeve 306.

In other embodiments, however, the sleeve orifices 308, the choke orifices 406 (FIG. 4A), and the clamp orifices 416 (FIG. 4B) may be aligned and arranged such that the fluid flow streams entering the assembly 200 via the cartridge choke assemblies 204 may enter at an angle that is substantially tangent to the body 202. In such embodiments, the fluid flow streams entering the body 202 via the cartridge choke assemblies 204 may proceed circumferentially about the inner surface of the inner sleeve 306 until impacting a fluid flow stream from an angularly adjacent cartridge choke assembly 204 configured to discharge its fluid flow stream in an opposing direction. As a result, the opposing fluid flow streams may substantially cancel each other out.

The assembly 200 may also prove advantageous in preventing erosion during injection operations. For instance, erosion mitigation may be achieved by controlling the geometry of the inlet, the outlet, and the cross-sectional flow path generated through the aligned orifices. As will be appreciated, this may effectively control the diffusion of jet streams exiting the cartridge choke assemblies 204. Erosion mitigation may further be achieved by placing selective deflector shields (not shown) on the exterior of the assembly to help guide the direction of the ejected fluid streams. Such deflector shields may be made of harder, erosion-resistant materials such as, but not limited to, a carbide grade, a carbide embedded in a matrix of cobalt or nickel by sintering, a ceramic, a surface hardened metal, a surface coated metal, a cermet-based material, a metal matrix composite, a nanocrystalline metallic alloy, an amorphous alloy, a hard metallic alloy, diamond, or any combination thereof.

Figure 5A:
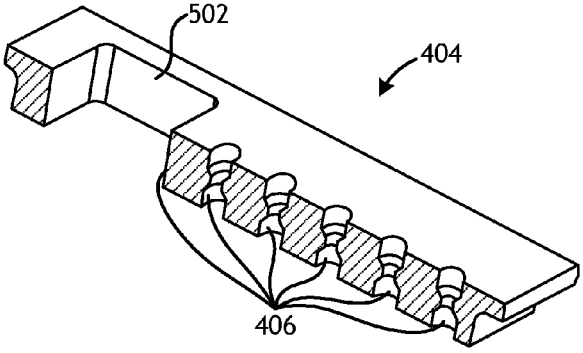
FIGS. 5A and 5B depict views of an exemplary embodiment of the choking module of FIGS. 4A and 4B.
Figure 5B:
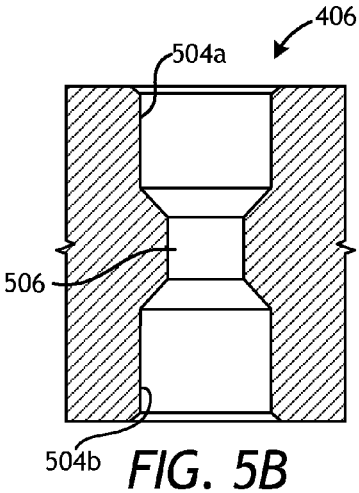

Referring now to FIGS. 5A and 5B, illustrated are views of an exemplary embodiment of the choking module 404 of FIGS. 4A and 4B. More particularly, FIG. 5A depicts a cross-sectional, isometric view of the choking module 404, and FIG. 5B depicts a cross-sectional side view of one of the choke orifices 406 of the choking module 404. In some embodiments, as illustrated in FIG. 5A, the choking module 404 may comprise a monolithic block of material and the choke orifices 406 may be defined through the block from top to bottom. As indicated above, the material for the choking module 404 may comprise any of the erosion-resistant materials mentioned herein. In at least one embodiment, however, the material for the choking module 404 may specifically comprise tungsten carbide or a ceramic material.

The choke orifices 406 may be positioned linearly along the length of the choking module 404 or may alternatively be staggered in various geometric or random patterns. In the illustrated embodiment, the choke orifices 406 are linearly aligned and include five smaller choke orifices 406 and a larger orifice 502. The larger orifice 502, sometimes called the "full-wide open orifice," may allow maximized fluid flow through the choking module 404 when the assembly 200 (FIGS. 3A and 3B) is in the fully open position. In some embodiments, the size of the smaller choke orifices 406 may progressively change along the length of the choking module 404, and thereby alter the fluid metering potential of the choking module 404. For instance, the smaller choke orifices 406 may become progressively smaller or larger from right to left in FIG. 5A. As will be appreciated, the size, design, and general configuration of the orifices 406 (including the full-wide open orifice 502) may be customized and optimized to fit a particular downhole application or operation.

With reference to FIG. 5B, each choke orifice 406 may include an inlet 504*a*, an outlet 504*b*, and a flow path 506 extending between the inlet 504*a* and the outlet 504*b*. As will be appreciated, the orientation of the inlet 504*a* and the outlet 504*b* may be reversed depending on whether production or injection operations are being conducted. The particular design of the orifice 406 may control flow performance and flow parameters, such as pressure drop across the choking module 404, the velocity of fluid flow through the choke orifice 406, and the coefficient of discharge (Cd) and valve (Cv) for the choking module 404. Other flow parameters that may be controlled by particular designs of the orifice 406 include a density of fluid flow through the choke orifice 406 and a viscosity of fluid flow through the choke orifice 406. In the illustrated embodiment, the flow path 406 defines a generally converging-diverging nozzle-type structure, which essentially creates a venturi effect across the choking module 404. As a result, the orifice 406 may prove advantageous in dispersing fluid energy entering or exiting the assembly 200 (FIGS. 3A and 3B).

Figure 6A:
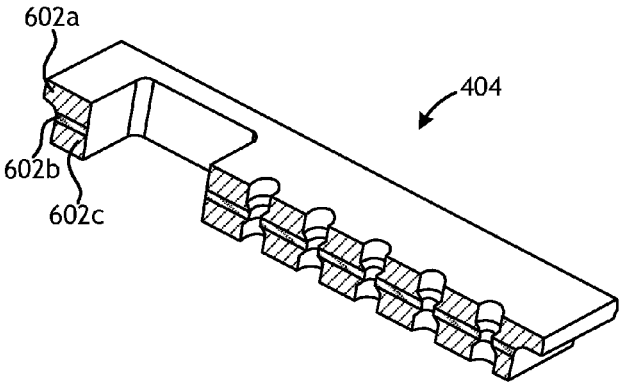
FIGS. 6A and 6B depict views of another exemplary embodiment of the choking module of FIGS. 4A and 4B.
Figure 6B:
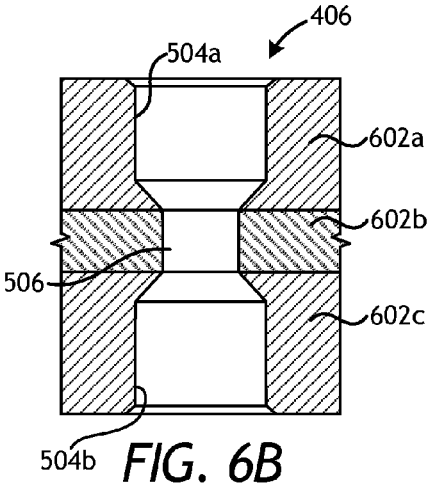

Referring now to FIGS. 6A and 6B, with continued reference to FIGS. 5A-5B, illustrated are views of another exemplary embodiment of the choking module 404 of FIGS. 4A and 4B. FIG. 6A depicts a cross-sectional, isometric view of the choking module 404, and FIG. 6B depicts a cross-sectional side view of one of the choke orifices 406 of the choking module 404. In the illustrated embodiment, the choking module 404 may comprise a layered structure that includes at least a first or top layer 602*a*, a second or middle layer 602*b*, and a third or bottom layer 602*c*. While only three layers 602*a-c* are shown in FIGS. 6A and 6B, it will be appreciated that more or less than three layers may be utilized in the choking module 404, without departing from the scope of the disclosure.

The layers 602*a-c* may be coupled and otherwise bonded to each other to form a monolithic structural component. Suitable attachment means include, but are not limited to mechanical fasteners (e.g., bolts, screws, etc.), welding, brazing, chemical bonding (e.g., an adhesives, etc.), diffusion bonding, and any combination thereof. The choke orifices 406 may be defined through each of the layers 602*a-c* to facilitate fluid flow through the choking module 404.

One advantage to having various layers 602*a-c* that make up the choking module 404 is the ability to increase the mechanical strength of the choking module 404, similar to how a composite material is mechanically strengthened by incorporating two or more materials. For instance, in at least one embodiment, the middle layer 602*b* may comprise an erosion-resistant material, such as any of the erosion-resistant materials mentioned herein. Erosion-resistant materials are generally brittle and prone to cracking upon assuming mechanical stress. To strengthen the middle layer 602*b*, one or both of the top and bottom layers 602*a,c* may be made of a more-ductile material, or a material that exhibits a higher/lower (differential) modulus of elasticity such as, but not limited to, ferrous metals and alloys, non-ferrous metals and alloys, metal foams, metal composites, para-aramid synthetic fibers (KEVLAR®), a carbon nanofiber fabric or wire, a non-metal composite, and any combination thereof. With one or both of the top and bottom layers 602*a,c* made of a more flexible or rigid material, the choking module 404 may exhibit a higher modulus of elasticity, thereby allowing the cartridge choke assembly 204 (FIGS. 3A-3B and 4A-4B) to flex more during operation.

Another advantage to having various layers 602*a-c* make up the choking module 404 is the ability to achieve intricate designs of the orifice 406 and, more particularly, the flow path 506 that extends between the inlet 504*a* and the outlet 504*b*. More particularly, a layered choking module 404 may allow for the design and fabrication of orifices 406 of various shapes, sizes, and designs that might otherwise be impossible or highly difficult to fabricate from a monolithic block of material.

Figure 7A:
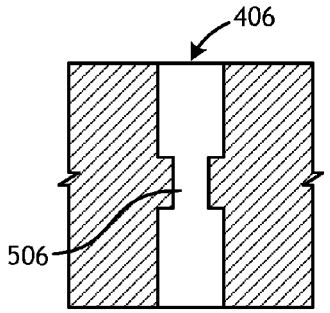
FIGS. 7A-7T depict cross-sectional side views of several exemplary designs for the choke orifice of FIGS. 5B and 6B.
Figure 7B:
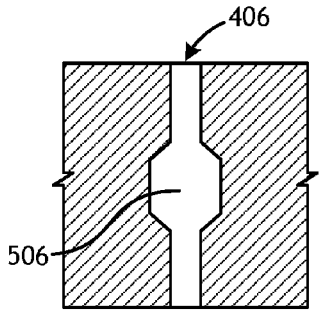
Figure 7C:
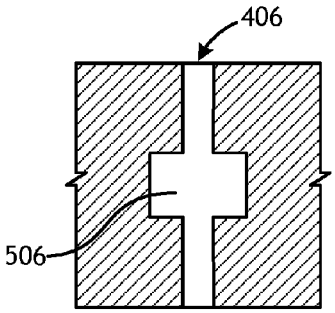
Figure 7D:
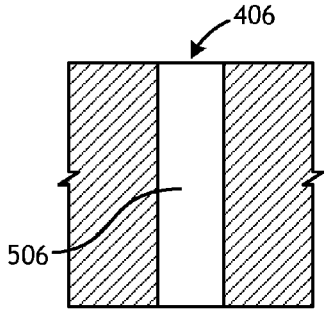
Figure 7E:
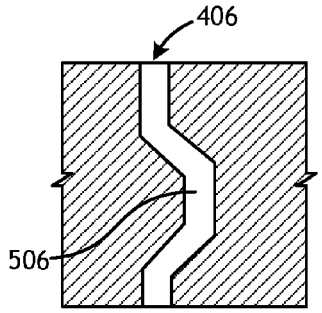
Figure 7F:
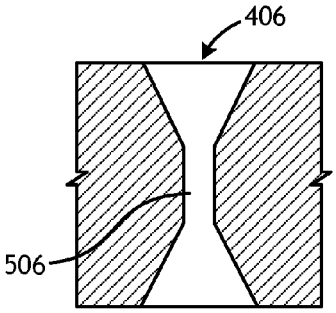
Figure 7G:
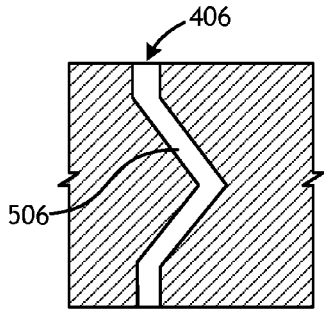
Figure 7H:
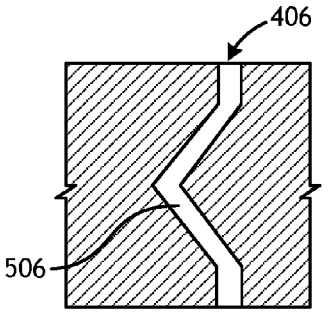
Figure 7I:
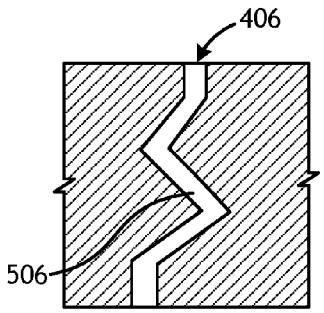
Figure 7J:
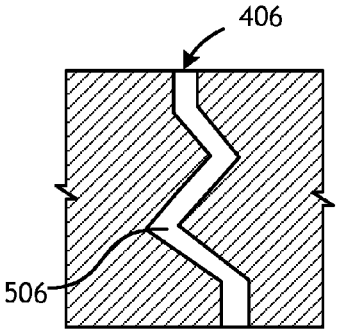
Figure 7K:
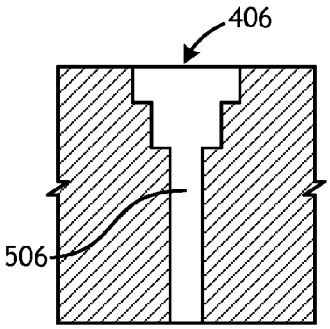
Figure 7L:
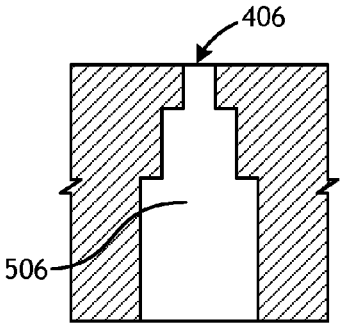
Figure 7M:
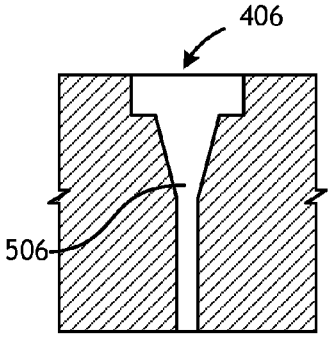
Figure 7N:
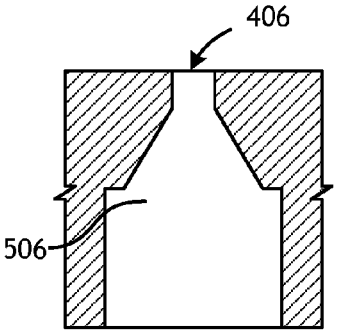
Figure 7O:
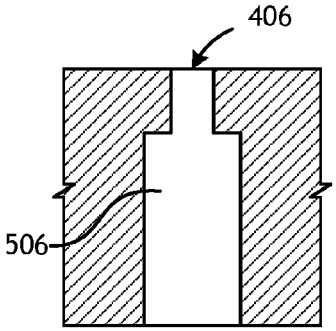
Figure 7P:
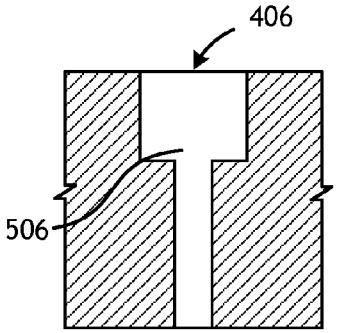
Figure 7Q:
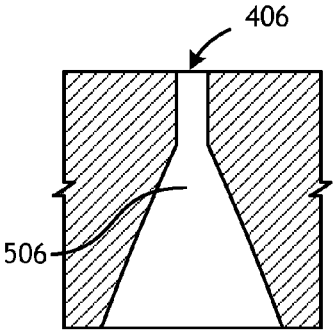
Figure 7R:
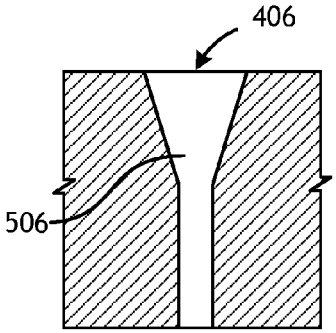
Figure 7S:
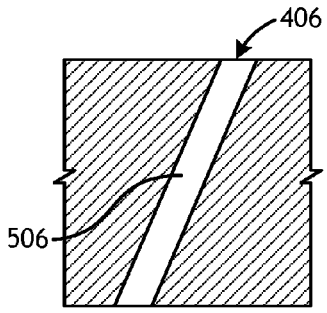
Figure 7T:
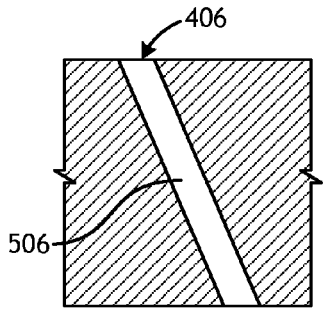

Referring to FIGS. 7A-7T, for example, and with continued reference to FIGS. 5B and 6B, illustrated are several exemplary designs for the choke orifice 406. While the cross-sectional views of FIGS. 7A-7T depict the choke orifice 406 as being defined in a choking module 404 made of a monolithic material, similar to FIG. 5B, it will be appreciated that any of the choke orifices 406 of FIGS. 7A-7T may alternatively be defined in a choking module 404 made of multiple layers 602*a-c*, similar to FIG. 6B.

As illustrated, the flow path 506 extending between the inlet and outlet 504*a,b* (FIGS. 5B and 6B) may exhibit a variety of designs and/or configurations. Generally, the flow path 506 may provide a tortuous conduit that extends between the inlet 504*a* and the outlet 504*b*, which may increase the pressure drop across the choking module 404 and thereby allow the choking module 404 to control the flow differently through the same cross-section. More particularly, for the same thickness (cross-section) between the inlet 504*a* and the outlet 504*b*, a different pressure drop may be achieved across the choking module 404 as a result of longer or angled flow paths 506, which result in increased flow friction and more angular energy loss.

The flow path 506 of some choke orifices 406, for instance, may exhibit a converging-diverging or diverging-converging design, such as shown in FIGS. 7A-7C and 7F. The flow path 506 of other choke orifices 406 may exhibit a narrowing design, such as shown in FIGS. 7K-7R. The flow path 506 of yet other choke orifices 406 may exhibit a tortuous flow path design, such as shown in FIGS. 7E and 7G-7J. The flow path 506 of even further choke orifices 406 may exhibit a generally linear design, such as shown in FIGS. 7D, 7S, and 7T. As will be appreciated, the inlet and outlet 504*a,b* in any of the choke orifices 406 may be reversed to accommodate particular flow applications.

As will be appreciated, differently designed flow paths 506 may be advantageous for different applications; i.e., injection, production, gas production, liquid production, etc., and the modular design of the choking module 404 may allow an operator to simply swap out one choking module 404 with another that is better suited for an application. The various designs of the orifice chokes 406 may allow manipulation of flow parameters by altering pressure and velocity profiles in various ways along the length of the flow path 506. The actual effects of these profiles can be determined by modeling, simulation, computational fluid dynamics analysis, and flow testing. This may help with well performance changes in due course for continued optimized reservoir control.

Figure 8A:
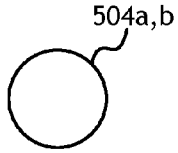
FIGS. 8A-8N depict top geometry views of the inlet and/or the outlet of several choke conduits.
Figure 8B:
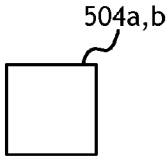
Figure 8C:
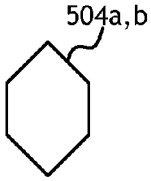
Figure 8D:
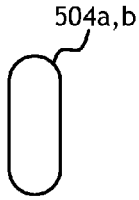
Figure 8E:
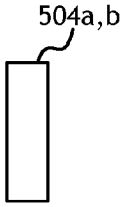
Figure 8F:
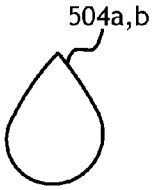
Figure 8G:
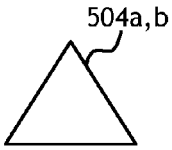
Figure 8H:
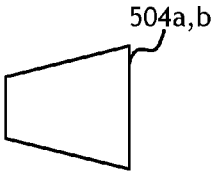
Figure 8I:
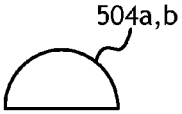
Figure 8J:
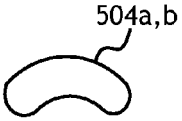
Figure 8K:
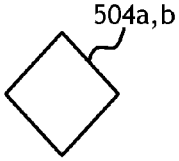
Figure 8L:
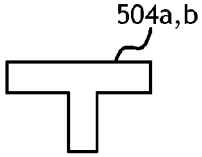
Figure 8M:
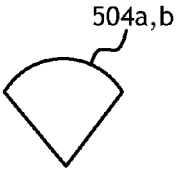
Figure 8N:
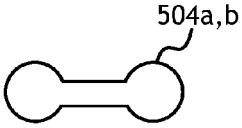

Referring now to FIGS. 8A-8N, with continued reference to FIGS. 7A-7T, illustrated are and views of the inlet 504*a* and/or the outlet 504*b* of any of the choke conduits 406 described herein, according to several embodiments. As illustrated, the inlet 504*a* and/or the outlet 504*b* may exhibit a variety of geometric shapes or configurations including, but not limited to, circular, ovular, ovoid, polygonal, polygonal with rounded corners, tear-drop, arcuate, and any combination thereof. As shown in FIG. 8N, the inlet 504*a* and/or the outlet 504*b* may exhibit a combination of geometric various shapes.

Figure 9A:
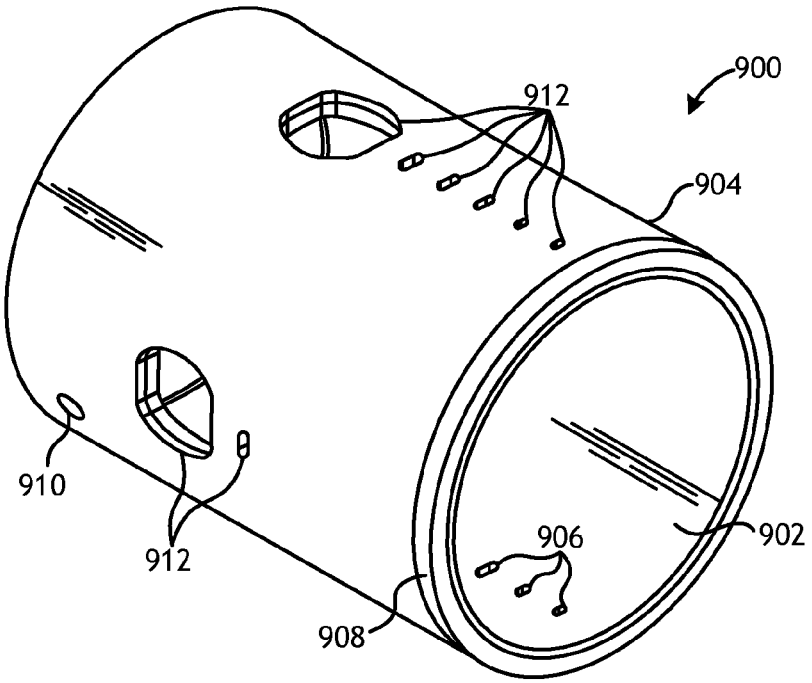
FIGS. 9A and 9B depict isometric and cross-sectional side views, respectively, of a composite choke assembly.
Figure 9B:
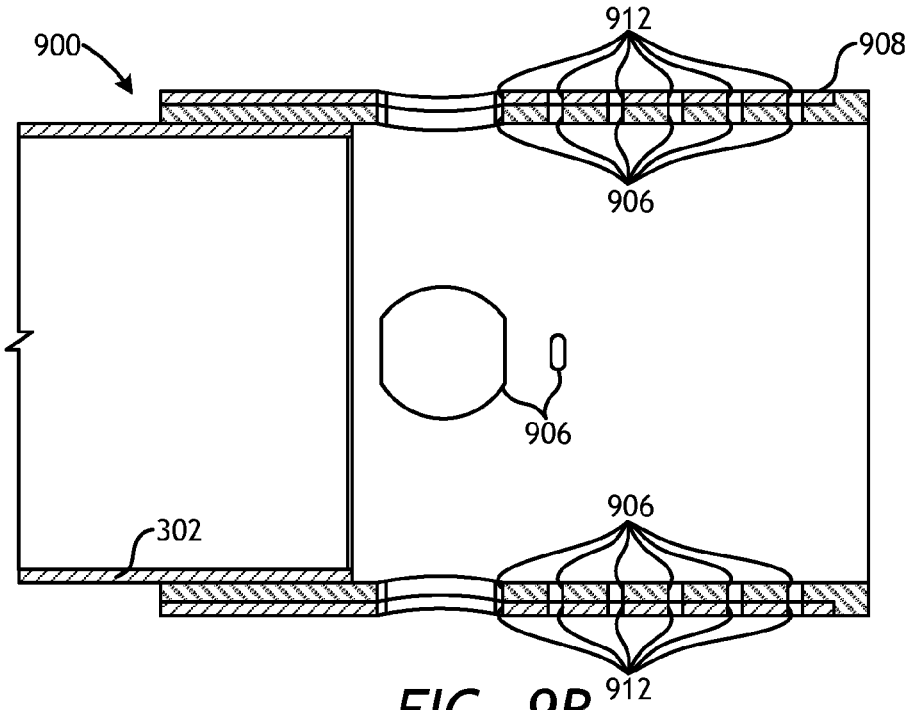

Referring now to FIGS. 9A and 9B, with continued reference to FIGS. 3A and 3B, illustrated are isometric and cross-sectional side views, respectively, of a composite choke assembly 900, according to one or more embodiments. The composite choke assembly 900 may be an alternative to and otherwise replace the cartridge choke assemblies 204 described herein. Accordingly, the composite choke assembly 900 may form part of the assembly 200 of FIGS. 2 and 3A-3B and may otherwise be secured within the body 202 to intelligently regulate fluid flow into or out of the body 202.

As illustrated, the composite choke assembly 900 may include an inner sleeve 902 and an outer sleeve 904. The inner sleeve 902 may be similar in some respects to the inner sleeve 306 described above with reference to FIGS. 3A-3B and 4A-4B. For instance, the inner sleeve 902 may be positioned within the body 202 and generally extend between the upper and lower seals 304*a,b* (FIGS. 3A-3B) such that the inner sleeve 902 interposes the upper and lower seals 304*a,b*. Moreover, in some embodiments, the inner sleeve 902 may be made of an erosion-resistant material such as, but not limited to, a carbide grade (e.g., tungsten, titanium, tantalum, vanadium, etc.), a carbide embedded in a matrix of cobalt or nickel by sintering, a ceramic, a surface hardened metal (e.g., nitrided metals, heat-treated metals, carburized metals, etc.), a surface coated metal, a cermet-based material, a metal matrix composite, a nanocrystalline metallic alloy, an amorphous alloy, a hard metallic alloy, diamond, or any combination thereof. The inner sleeve 902 may also define and otherwise provide one or more choke orifices 906 that extend through the wall of the inner sleeve 902 at strategic locations. For instance, the inner sleeve 902 may be oriented within the body 202 of the assembly 200 such that the choke orifices 906 align and otherwise coincide with the openings 206 defined in the body 202, thereby facilitating fluid flow into or out of the body 202 via the composite choke assembly 900.

The inner and outer sleeves 902, 904 may be generally cylindrical and the outer sleeve 904 may be sized to receive the inner sleeve 902 within its interior. In some embodiments, the inner sleeve 902 may define a radial shoulder 908 at one end, and the outer sleeve 904 may be extended over the inner sleeve 902 until engaging the radial shoulder 908. The outer sleeve 904 may be made of a material that is more ductile or exhibits a higher modulus of elasticity as compared to the material of the inner sleeve 902. Suitable materials for the outer sleeve 904 include, but are not limited to, ferrous metals and alloys (e.g., stainless steel, chromium steel, nickel alloys, etc.), non-ferrous metals and alloys (e.g., aluminum, titanium, brass, copper, and any alloy thereof), a metal foam, a metal composite, para-aramid synthetic fibers (KEVLAR®), a carbon nanofiber fabric or wire, any combination thereof.

The outer sleeve 904 may be coupled to the outer surface of the inner sleeve 902 such that a pre-compression load is applied to the inner sleeve 902. In some embodiments, for example, the outer sleeve 904 may be shrink fit or press fit to the outer surface of the inner sleeve 902, and thereby transfer a compressive load to the inner sleeve 902. As will be appreciated, placing the inner sleeve 902 in pre-compression may prove advantageous in mitigating potential for cracking or failure of the relatively brittle material of the inner sleeve 902 when assuming mechanical stresses during operation.

In at least one embodiment, the outer sleeve 904 may define a perforation 910 configured to receive a mechanical fastener (not shown), such as a screw, a bolt, a pin, etc., that may be extended through the perforation 910 and at least partially into the inner sleeve 902 located therebelow. The mechanical fastener may operate to prevent rotation of the outer sleeve 904 with respect to the inner sleeve 902 and, therefore, may be characterized as an anti-rotation pin.

The outer sleeve 904 may define one or more sleeve orifices 912 that extend through the wall of the outer sleeve 904. The sleeve orifices 912 may be configured to generally align with the choke orifices 906 to facilitate fluid communication either into or out of the assembly 200 (FIGS. 3A and 3B) via the composite choke assembly 900. Accordingly, the sleeve orifices 912 may also be positioned to align and otherwise coincide with the openings 206 in the body 202. The openings to either of the choke or sleeve orifices 906, 912 may exhibit a variety of geometric shapes or configurations including, but not limited to, circular, ovular, ovoid, polygonal, polygonal with rounded corners, tear-drop, arcuate, and any combination thereof.

In some embodiments, aligned choke and sleeve orifices 906, 912 may be positioned linearly along the axial length of the composite choke assembly 900. In other embodiments, however, aligned choke and sleeve orifices 906, 912 may alternatively be staggered or defined in various geometric or random patterns. Each set of aligned choke and sleeve orifices 906, 912 may be positioned diametrically-opposite another set of aligned choke and sleeve orifices 906, 912 of the same number and configuration. In the illustrated embodiment, the aligned choke and sleeve orifices 906, 912 are depicted as being arranged at an angle substantially orthogonal to the longitudinal axis of the assembly 200. As a result, opposing fluid flow streams entering the body 202 via the composite choke assembly 900 may impact each other within the body 202 and substantially dissipate the energy prior to impinging upon the inner sleeve 902.

In other embodiments, however, aligned choke and sleeve orifices 906, 912 may be aligned and arranged such that the fluid flow streams entering the assembly 200 via the cartridge choke assemblies 204 may enter at an angle that is substantially tangent to the body 202. In such embodiments, the fluid flow streams entering the body 202 via the composite choke assembly 900 may proceed circumferentially about the inner surface of the inner sleeve 902 until impacting a fluid flow stream from an angularly adjacent set of aligned choke and sleeve orifices 906, 912 that discharge its fluid flow stream in an opposing direction. As a result, the opposing fluid flow streams may substantially cancel each other out.

Each set of aligned choke and sleeve orifices 906, 912 may comprise any number of orifices 906, 912. In the illustrated embodiment, for instance, sets of aligned choke and sleeve orifices 906, 912 are depicted as comprising five smaller orifices leading to a larger orifice. Other illustrated sets of aligned choke and sleeve orifices 906, 912 are depicted as comprising only one smaller orifice and a larger orifice. As discussed above, the larger orifice may be characterized as the "full-wide open orifice," which may allow maximized fluid flow through the composite choke assembly 900 when the assembly 200 (FIGS. 3A and 3B) is in the fully open position. In some embodiments, the sizes and/or dimensions of the aligned choke and sleeve orifices 906, 912 may progressively change along the axial length of the composite choke assembly 900, and thereby alter the fluid metering potential of the composite choke assembly 900. For instance, the smaller orifices may become progressively smaller or larger from right to left in FIG. 9A or 9B. As will be appreciated, the size, design, and general configuration of the aligned choke and sleeve orifices 906, 912 (including the full-wide open orifice 502) may be customized and optimized to fit a particular downhole application or operation.

In some embodiments, the sleeve orifices 912 may exhibit a larger diameter and may otherwise be wider than the choke orifices 906. As will be appreciated, this may ensure that the throttling action during operation takes place through the choke orifices 906, which are provided in a harder material that exhibits greater erosion-resistance. The higher strength and toughness of the softer material of the outer sleeve 904, however, may serve to maintain circumferential compressive thrust on the inner sleeve 902 during operation. From a mechanical strength and stability standpoint, the outer sleeve 904 geometrically has better inherent stress resistance as compared to a cylindrical choke under differential burst pressures assumed during injection operations. In other words, by nature of the form factor and the cross-sectional thickness, combined with linear dimensional aspect ratio, the outer sleeve 904 may be designed to sustain high burst pressures. As a result, the outer sleeve 904 may prove advantageous in combating hoop stresses and forces assumed by the inner sleeve 902 due to high flowing differentials.

With reference to FIG. 9B, the flow control device 302 may be movable to throttle or "choke" the fluid flow through the composite choke assembly 900, and thereby intelligently regulate the flow rate into or out of the assembly 200 (FIGS. 2 and 3A-3B). Moving the flow control device 302 toward the fully open position, as shown in FIG. 9B, for instance, may result in increased fluid flow into or out of the assembly 200 as additional aligned choke and sleeve orifices 906, 912 progressively become exposed. In contrast, moving the flow control device 302 toward the fully closed position, where the choke and sleeve orifices 906, 912 are all occluded by the flow control device 302, may result in decreased fluid flow into or out of the assembly 200 as the aligned choke and sleeve orifices 906, 912 progressively become occluded.

The inner sleeve 902 may operate to provide erosion protection to the inner surfaces of the body 202 and other features of the assembly 200 that may lie in the vicinity of impinging fluid flow streams passing through the composite choke assembly 900. More particularly, sand particles and other debris entrained in fluid flow streams traversing the composite choke assembly 900 may impact the inner wall of the body 202 and result in erosion or abrasion. Since it is made of an erosion-resistant material, however, the inner sleeve 902 may mitigate or prevent erosion to the body 202 that might otherwise ensue due to impinging jets, vortices, and turbulent flow through the composite choke assembly 900.

The mechanical strength and stability of the composite choke assembly 900 may provide a robustness advantage over a single material cylindrical choke under burst pressure resulting from flowing differential during injection operations. As will be appreciated, the intelligent use of prestresses applied by the outer sleeve 904 to create mechanical leverage helps the composite choke assembly 900 to sustain high burst pressures as compared to a conventional cylindrical choke assembly for the same form factor.

Embodiments disclosed herein include:

A. A flow control assembly includes a cylindrical body that defines an interior and one or more openings provided through a wall of the body, a composite choke assembly positioned within the body and including an inner sleeve made of a first material and defining one or more choke orifices that coincide with the one or more openings, and an outer sleeve sized to receive the inner sleeve within the outer sleeve and being made of a second material that is more ductile than the first material, wherein the outer sleeve defines one or more sleeve orifices alignable with the one or more choke orifices to facilitate fluid communication through the composite choke assembly, and a flow control device movably disposed within the body between a fully open position, where the one or more choke orifices and the one or more sleeve orifices are exposed and fluid flow into or out of the body via the composite choke assembly is facilitated, and a fully closed position, where the one or more choke orifices and the one or more sleeve orifices are occluded by the flow control device and fluid flow into or out of the body via the composite choke assembly is thereby prevented.

B. A well system that includes a tubing string extendable within a wellbore, at least one flow control assembly positioned between upper and lower segments of the tubing string and including a cylindrical body that defines an interior and one or more openings provided through a wall of the body, wherein the interior is in fluid communication with the tubing string, a composite choke assembly positioned within the body and including an inner sleeve made of a first material and defining one or more choke orifices that coincide with the one or more openings, and an outer sleeve sized to receive the inner sleeve within the outer sleeve and being made of a second material that is more ductile than the first material, wherein the outer sleeve defines one or more sleeve orifices alignable with the one or more choke orifices to facilitate fluid communication through the composite choke assembly, and a flow control device movably disposed within the body between a fully open position, where the one or more choke orifices and the one or more sleeve orifices are exposed and fluid flow into or out of the at least one flow control assembly via the composite choke assembly is facilitated, and a fully closed position, where the one or more choke orifices and the one or more sleeve orifices are occluded by the flow control device and fluid flow into or out of the at least one flow control assembly via the composite choke assembly is thereby prevented.

C. A method that includes introducing a tubing string into a wellbore, the tubing string having at least one flow control assembly positioned between upper and lower segments of the tubing string, wherein the at least one flow control assembly includes a cylindrical body that defines an interior and one or more openings provided through a wall of the body, wherein the interior is in fluid communication with the tubing string, a composite choke assembly positioned within the body and including an inner sleeve made of a first material and defining one or more choke orifices that coincide with the one or more openings, the composite choke assembly further including an outer sleeve sized to receive the inner sleeve within the outer sleeve and being made of a second material that is more ductile than the first material, wherein the outer sleeve defines one or more sleeve orifices alignable with the one or more choke orifices to facilitate fluid communication through the composite choke assembly, and a flow control device movably disposed within the body between a fully open position, where the one or more choke orifices and the one or more sleeve orifices are exposed and fluid flow into or out of the at least one flow control assembly via the composite choke assembly is facilitated, and a fully closed position, where the one or more choke orifices and the one or more sleeve orifices are occluded by the flow control device and fluid flow into or out of the at least one flow control assembly via the composite choke assembly is thereby prevented, and actuating the flow control device to regulate the fluid flow into or out of the at least one flow control assembly via the composite choke assembly.

Each of embodiments A, B, and C may have one or more of the following additional elements in any combination: Element 1: wherein the flow control device is selected from the group consisting of a sliding sleeve, a rotating sleeve, a sliding plug, a rotating ball, an oscillating vane, an opening pocket, an opening window, a valve, and any combination thereof. Element 2: wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof. Element 3: wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof. Element 4: wherein the one or more sleeve orifices and the one or more choke orifices are aligned orthogonal to a longitudinal axis of the body. Element 5: wherein the one or more sleeve orifices and the one or more choke orifices are aligned at an angle that is tangent to the body. Element 6: wherein the inner sleeve defines a radial shoulder at one end, and the inner sleeve is extended into the outer sleeve until engaging the radial shoulder. Element 7: wherein the outer sleeve is coupled to the inner sleeve such that a pre-compression load is applied to the inner sleeve. Element 8: wherein the outer sleeve is shrink fit to the inner sleeve. Element 9: wherein the composite choke assembly further comprises a first set of aligned choke and sleeve orifices defined through the inner and outer sleeves at a first location, and a second set of aligned choke and sleeve orifices defined through the inner and outer sleeves at a second location diametrically-opposite the first location. Element 10: wherein a size of the one or more sleeve orifices is greater than a size of the one or more choke orifices.

Element 11: wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof. Element 12: wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof. Element 13: wherein the outer sleeve is coupled to the inner sleeve such that a pre-compression load is applied to the inner sleeve. Element 14: wherein the composite choke assembly further comprises a first set of aligned choke and sleeve orifices defined through the inner and outer sleeves at a first location, and a second set of aligned choke and sleeve orifices defined through the inner and outer sleeves at a second location diametrically-opposite the first location.

Element 15: further comprising mitigating erosion of the body with the inner sleeve, wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof. Element 16: further comprising coupling the outer sleeve to the inner sleeve such that a pre-compression load is applied to the inner sleeve. Element 17: further comprising shrink fitting the outer sleeve to the inner sleeve, wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof. Element 18: wherein the composite choke assembly further includes a first set of aligned choke and sleeve orifices defined through the inner and outer sleeves at a first location, and a second set of aligned choke and sleeve orifices defined through the inner and outer sleeves at a second location diametrically-opposite the first location, the method further comprising drawing in one or more first fluid flow streams via the first set of aligned choke and sleeve orifices, drawing in one or more second fluid flow streams via the second set of aligned choke and sleeve orifices, and impacting the one or more first fluid flow streams against the one or more second fluid flow streams. Element 19: wherein actuating the flow control device comprises moving the flow control device toward the fully open position and thereby increasing the fluid flow into or out of the at least one flow control assembly via the composite choke assembly. Element 20: wherein actuating the flow control device comprises moving the flow control device toward the fully closed position and thereby decreasing the fluid flow into or out of the at least one flow control assembly via the composite choke assembly.

By way of non-limiting example, exemplary combinations applicable to A, B, and C include: Element 7 with Element 8; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A flow control assembly, comprising:

a cylindrical body that defines an interior and one or more openings through a wall of the body;

a composite choke assembly positioned within the body and including:

an inner sleeve made of a first material and defining one or more choke orifices that coincide with the one or more openings through the wall of the body; and an outer sleeve to receive the inner sleeve within the outer sleeve and being made of a second material that is more ductile than the first material, wherein the outer sleeve defines one or more sleeve orifices alignable with respective ones of the choke orifices on the inner sleeve to allow fluid communication through the composite choke assembly, wherein the outer sleeve is coupled to the inner sleeve such that a pre-compression load is applied to the inner sleeve; and a flow control device movably disposed within the body between a fully open position, where the choke orifices and the respective sleeve orifices are exposed for fluid flow into or out of the body via the composite choke assembly, and a fully closed position, where the flow control device occludes the choke orifices and the sleeve orifices to prevent fluid flow into or out of the body via the composite choke assembly.

2. The flow control assembly of claim 1, wherein the flow control device is selected from the group consisting of a sliding sleeve, a rotating sleeve, a sliding plug, a rotating ball, an oscillating vane, an opening pocket, an opening window, a valve, and any combination thereof.

3. The flow control assembly of claim 1, wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

4. The flow control assembly of claim 1, wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof.

5. The flow control assembly of claim 1, wherein the one or more sleeve orifices and the one or more choke orifices are aligned orthogonal to a longitudinal axis of the body.

6. The flow control assembly of claim 1, wherein the one or more sleeve orifices and the one or more choke orifices are aligned at an angle that is tangent to the body.

7. The flow control assembly of claim 1, wherein the inner sleeve defines a radial shoulder at one end, and the inner sleeve is extended into the outer sleeve until engaging the radial shoulder.

8. The flow control assembly of claim 1, wherein the outer sleeve is shrink fit to the inner sleeve.

9. The flow control assembly of claim 1, wherein the composite choke assembly further comprises:

a first set of aligned choke and sleeve orifices defined through the inner and outer sleeves at a first location; and a second set of aligned choke and sleeve orifices defined through the inner and outer sleeves at a second location diametrically-opposite the first location.

10. The flow control assembly of claim 1, wherein a first size of the one or more sleeve orifices is greater than a second size of the one or more choke orifices.

11. A well system, comprising:

a tubing string extendable within a wellbore;

at least one flow control assembly positioned between upper and lower segments of the tubing string and including a cylindrical body that defines an interior and one or more openings through a wall of the body, wherein the interior is in fluid communication with the tubing string;

a composite choke assembly positioned within the body and including:

an inner sleeve made of a first material and defining one or more choke orifices that coincide with the one or more openings through the wall of the body; and an outer sleeve to receive the inner sleeve within the outer sleeve and being made of a second material that is more ductile than the first material, wherein the outer sleeve defines one or more sleeve orifices alignable with respective ones of the choke orifices on the inner sleeve to allow fluid communication through the composite choke assembly, wherein the outer sleeve is coupled to the inner sleeve such that a pre-compression load is applied to the inner sleeve; and a flow control device movably disposed within the body between a fully open position, where the choke orifices and the sleeve orifices are exposed for fluid flow into or out of the at least one flow control assembly via the composite choke assembly, and a fully closed position, where the choke orifices and the sleeve orifices are occluded by the flow control device to prevent fluid flow into or out of the at least one flow control assembly via the composite choke assembly.

12. The well system of claim 11, wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

13. The well system of claim 11, wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof.

14. The well system of claim 11, wherein the composite choke assembly further comprises:

a first set of aligned choke and sleeve orifices defined through the inner and outer sleeves at a first location; and a second set of aligned choke and sleeve orifices defined through the inner and outer sleeves at a second location diametrically-opposite the first location.

15. A method, comprising:

introducing a tubing string into a wellbore, the tubing string having at least one flow control assembly positioned between upper and lower segments of the tubing string, wherein the at least one flow control assembly includes:

a cylindrical body that defines an interior and one or more openings through a wall of the body, wherein the interior is in fluid communication with the tubing string;

a composite choke assembly positioned within the body and including an inner sleeve made of a first material and defining one or more choke orifices that coincide with the one or more openings, the composite choke assembly further including an outer sleeve to receive the inner sleeve within the outer sleeve and being made of a second material that is more ductile than the first material, wherein the outer sleeve defines one or more sleeve orifices alignable with respective ones of the choke orifices on the inner sleeve to allow fluid communication through the composite choke assembly; and a flow control device movably disposed within the body between a fully open position, where the choke orifices and the sleeve orifices are exposed for fluid flow into or out of the at least one flow control assembly via the composite choke assembly, and a fully closed position, where the choke orifices and the sleeve orifices are occluded by the flow control device to prevent fluid flow into or out of the at least one flow control assembly via the composite choke assembly;

actuating the flow control device to regulate the fluid flow into or out of the at least one flow control assembly via the composite choke assembly, and;

coupling the outer sleeve to the inner sleeve such that a pre-compression load is applied to the inner sleeve.

16. The method of claim 15, further comprising mitigating erosion of the body with the inner sleeve, wherein the first material comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

17. The method of claim 15, further comprising shrink fitting the outer sleeve to the inner sleeve, wherein the second material comprises a material selected from the group consisting of a ferrous metal, a ferrous alloy, a non-ferrous metal, a non-ferrous alloy, a metal foam, a metal composite, a para-aramid synthetic fiber, a carbon nanofiber fabric or wire, and any combination thereof.

18. The method of claim 15, wherein the composite choke assembly further includes a first set of aligned choke and sleeve orifices defined through the inner and outer sleeves at a first location, and a second set of aligned choke and sleeve orifices defined through the inner and outer sleeves at a second location diametrically-opposite the first location, the method further comprising:

drawing in one or more first fluid flow streams via the first set of aligned choke and sleeve orifices;

drawing in one or more second fluid flow streams via the second set of aligned choke and sleeve orifices; and impacting the one or more first fluid flow streams against the one or more second fluid flow streams.

19. The method of claim 15, wherein actuating the flow control device comprises moving the flow control device toward the fully open position and thereby increasing the fluid flow into or out of the at least one flow control assembly via the composite choke assembly.

20. The method of claim 15, wherein actuating the flow control device comprises moving the flow control device toward the fully closed position and thereby decreasing the fluid flow into or out of the at least one flow control assembly via the composite choke assembly.

* * * * *